US011159888B1

(12) United States Patent
Zou et al.

(10) Patent No.: US 11,159,888 B1
(45) Date of Patent: Oct. 26, 2021

(54) TRANSDUCER COOLING BY INTRODUCTION OF A COOLING COMPONENT IN THE TRANSDUCER INPUT SIGNAL

(71) Applicant: CIRRUS LOGIC INTERNATIONAL SEMICONDUCTOR, LTD., Edinburgh (GB)

(72) Inventors: Ziyan Zou, Austin, TX (US); Anthony S. Doy, Los Gatos, CA (US); Ning Li, Cedar Park, TX (US); Kaichow Lau, Austin, TX (US); George E. Hardy, Austin, TX (US); John L. Melanson, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 0 days.

(21) Appl. No.: 17/025,971

(22) Filed: Sep. 18, 2020

(51) Int. Cl.
*H04R 29/00* (2006.01)
*H04R 9/02* (2006.01)
(Continued)

(52) U.S. Cl.
CPC ..... *H04R 9/022* (2013.01); *G10L 21/0272* (2013.01); *G10L 25/21* (2013.01);
(Continued)

(58) Field of Classification Search
CPC ..... H04R 9/022; H04R 1/025; H04R 3/04; H04R 9/046; H04R 9/06; H04R 29/001;
(Continued)

(56) References Cited

U.S. PATENT DOCUMENTS 6,370,254 B1 4/2002 Gore et al.
6,473,662 B2 10/2002 Lubbe et al.
(Continued)

FOREIGN PATENT DOCUMENTS

WO WO 2008138349 A2 11/2008
WO WO 2017222562 A1 12/2017
WO WO 2018069900 A1 4/2018

OTHER PUBLICATIONS

Final Office Action in U.S. Appl. No. 16/255,537 dated Mar. 18, 2020, 16 pages (pp. 1-16 in pdf).
(Continued)

*Primary Examiner* — Ammar T Hamid
(74) *Attorney, Agent, or Firm* — Mitch Harris, Atty at Law, LLC; Andrew M. Harris

(57) ABSTRACT

Methods, systems, circuits and computer program products provide an output signal to drive an electromechanical transducer that selectively contains a cooling component when a thermal limit of a voice coil of the electromechanical transducer is exceeded and which air-cools the transducer by convection. An indication of a temperature of a voice coil of the electromechanical transducer is determined and compared with a thermal limit of the transducer. If the thermal limit of the transducer is exceeded by the indication of the temperature of the voice coil, the cooling component is introduced to the output signal that drives the transducer. The cooling component is a signal having a frequency within a low-frequency resonance portion of the response of the electromechanical transducer, so that additional air convection is caused at the transducer to remove heat from the voice coil due to the cooling component of the output signal.

25 Claims, 7 Drawing Sheets

(51) Int. Cl.

| | |
|---|---|
| ***H04R 9/06*** | (2006.01) |
| ***H04R 3/04*** | (2006.01) |
| ***H04R 1/02*** | (2006.01) |
| ***G10L 21/0272*** | (2013.01) |
| ***G10L 25/21*** | (2013.01) |
| ***H04R 9/04*** | (2006.01) |

(52) U.S. Cl.
CPC ..... *H04R 1/025* (2013.01); *H04R 3/04* (2013.01); *H04R 9/046* (2013.01); *H04R 9/06* (2013.01); *H04R 29/001* (2013.01); *H04R 2400/03* (2013.01)

(58) Field of Classification Search
CPC .. H04R 2400/03; G10L 21/0272; G10L 25/21
USPC ..... 381/59
See application file for complete search history.

(56) References Cited

U.S. PATENT DOCUMENTS

| | | | |
|---|---|---|---|
| 6,771,791 | B2 | 8/2004 | Shelley et al. |
| 6,968,064 | B1 | 11/2005 | Ning |
| 7,092,537 | B1 | 8/2006 | Allred et al. |
| 7,302,062 | B2 | 11/2007 | Christoph |
| 7,447,318 | B2 | 11/2008 | Button et al. |
| 8,170,221 | B2 | 5/2012 | Christoph |
| 8,498,430 | B2 | 7/2013 | Hess et al. |
| 8,521,518 | B2 | 8/2013 | Jung et al. |
| 8,560,320 | B2 | 10/2013 | Yu |
| 8,693,699 | B2 | 4/2014 | Fellers et al. |
| 8,855,322 | B2 | 10/2014 | Ryu et al. |
| 8,937,537 | B2 | 1/2015 | Jaisimha et al. |
| 9,161,126 | B2 | 10/2015 | Su et al. |
| 9,173,027 | B2 | 10/2015 | Su |
| 9,225,310 | B1 | 12/2015 | Lukin |
| 9,306,525 | B2 | 4/2016 | Krishnaswamy et al. |
| 9,344,828 | B2 | 5/2016 | Bongiovi et al. |
| 9,386,386 | B2 | 7/2016 | Risberg et al. |
| 9,635,459 | B2 | 4/2017 | Jung et al. |
| 9,668,074 | B2 | 5/2017 | Drullinger et al. |
| 9,697,847 | B2 | 7/2017 | Dehghani et al. |
| 9,704,497 | B2 | 7/2017 | Porter et al. |
| 9,729,951 | B2 | 8/2017 | Wolf et al. |
| 9,735,746 | B2 | 8/2017 | Christoph |
| 9,762,198 | B2 | 9/2017 | Seefeldt |
| 9,807,502 | B1 | 10/2017 | Hatab et al. |
| 9,877,107 | B2 | 1/2018 | Painter et al. |
| 10,356,521 | B2 | 7/2019 | Lawrence et al. |
| 10,559,316 | B2 | 2/2020 | Cassidy et al. |
| 2005/0188743 | A1* | 9/2005 | Land ..... G01N 29/30 73/1.82 |
| 2007/0160221 | A1* | 7/2007 | Pfaffinger ..... H04R 29/001 381/59 |
| 2012/0051558 | A1 | 3/2012 | Kim et al. |
| 2017/0169674 | A1* | 6/2017 | Macours ..... G08B 6/00 |
| 2019/0166431 | A1* | 5/2019 | Hare ..... H04R 9/022 |
| 2019/0230438 | A1 | 7/2019 | Hatab et al. |
| 2020/0077188 | A1* | 3/2020 | D'Amato ..... H04R 3/04 |

OTHER PUBLICATIONS

Painter, et al., "Perceptual Coding of Digital Audio", Proceedings of the IEEE, vol. 88, issue 4, Apr. 2000, 66 pages (pp. 1-66 in pdf), IEEE, US.

Chen, et al., "A 2.5 Tablet Speaker Delivering 3.2W Pseudo High Power by Psychoacoustic Model Based Adaptve Power Management System", IEEE Asian Solid-State Circuits Conf., Nov. 10-12, 2014, pp. 221-224, IEEE, TW.

Chiu, "Efficient Audio Signal Processing for Embedded Systems", Thesis Presented to Academic Faculty, Georgia Institute of Technology, Aug. 2012, 124 pages (pp. 1-124 in pdf), US.

* cited by examiner

TRANSDUCER COOLING BY INTRODUCTION OF A COOLING COMPONENT IN THE TRANSDUCER INPUT SIGNAL

BACKGROUND

1. Field of Disclosure

The field of representative embodiments of this disclosure relates to audio power reproduction methods, circuits and systems that use movement of a transducer to cool the transducer voice coil.

2. Background

Voice coil-based acoustic output transducers, such as micro speakers and haptic feedback devices that may be included in personal devices, typically contain a voice coil that is energized by an amplifier or pulse-width modulator output. Typically, electrically-induced failure of a micro-speaker is due to either overcurrent through the voice coil resulting in immediate catastrophic failure, or thermal failure caused by overheating of the voice coil, which may melt the voice coil conductor or insulation, demagnetize the permanent magnet of the transducer, or cause other overheating-related failures such as melting of a plastic frame. Therefore, thermal limits set an upper bound on energy that may be provided to an electroacoustic transducer and thus on the maximum acoustic output that may be produced by a device. Similarly, haptic devices have tactile vibration limits determined by thermal limitations.

Typical thermal protection techniques for use in protecting speakers involve either absolute and conservative limits on voice coil excursion and power dissipation, such as a thermal protection switch mounted on the frame of a loudspeaker. More sophisticated techniques applicable to all speakers including micro-speakers use a feedback system in which a temperature of the voice coil is estimated from a calculation of voice coil resistance based on measurements of voltage and current at the terminals of the transducer. The power output circuit can either be shut down or the amplitude of the power output signal reduced in order to prevent transducer failure. In other solutions, such as that disclosed in U.S. Pat. No. 6,771,791, cooling of a loudspeaker voice coil is provided by a mechanical design of the loudspeaker that causes the loudspeaker to act as an air pump, so that as the loudspeaker is operated, the loudspeaker self-cools.

Therefore, it is advantageous to provide techniques for reducing or preventing thermal overload in micro-speakers.

SUMMARY

Thermal protection of an electromechanical transducer may be achieved in systems, circuits, computer program products and their methods of operation.

The methods, systems, circuits and computer program products thermally protect an electromechanical transducer that reproduces an input signal by determining an indication of a temperature of a voice coil of the electromechanical transducer and comparing the indication of the temperature of the voice coil to a thermal limit of the transducer. In response to the thermal limit of the transducer being exceeded by the indication of the temperature of the voice coil, a cooling component is introduced to the output signal that drives the transducer. The cooling component is a signal having a frequency within a low-frequency resonance portion of the response of the electromechanical transducer, so that additional air convection is caused at the transducer to remove heat from the voice coil due to the cooling component of the output signal.

The summary above is provided for brief explanation and does not restrict the scope of the Claims. The description below sets forth example embodiments according to this disclosure. Further embodiments and implementations will be apparent to those having ordinary skill in the art. Persons having ordinary skill in the art will recognize that various equivalent techniques may be applied in lieu of, or in conjunction with, the embodiments discussed below, and all such equivalents are encompassed by the present disclosure.

DETAILED DESCRIPTION OF ILLUSTRATIVE EMBODIMENT

The present disclosure encompasses methods, systems, circuits and computer program products that provide an output signal to drive an electromechanical transducer, which may be a micro-speaker, haptic or other form of electromechanical or electroacoustic transducer based on an input signal. The techniques illustrated herein provide thermal protection by air-cooling the transducer by convention caused by the introduction of a cooling component to the output signal that drives the electromechanical transducer. The methods, systems, circuits and computer program products determine an indication of a temperature of a voice coil of the electromechanical transducer and compare the indication of the temperature of the voice coil to a thermal limit of the transducer. If the thermal limit of the transducer is exceeded by the indication of the temperature of the voice coil, the cooling component is introduced to the output signal that drives the transducer. The cooling component is a signal having a frequency within a low-frequency resonance portion of the response of the electromechanical transducer, so that additional air convection is caused at the transducer to remove heat from the voice coil due to the cooling component of the output signal.

Figure 1A:
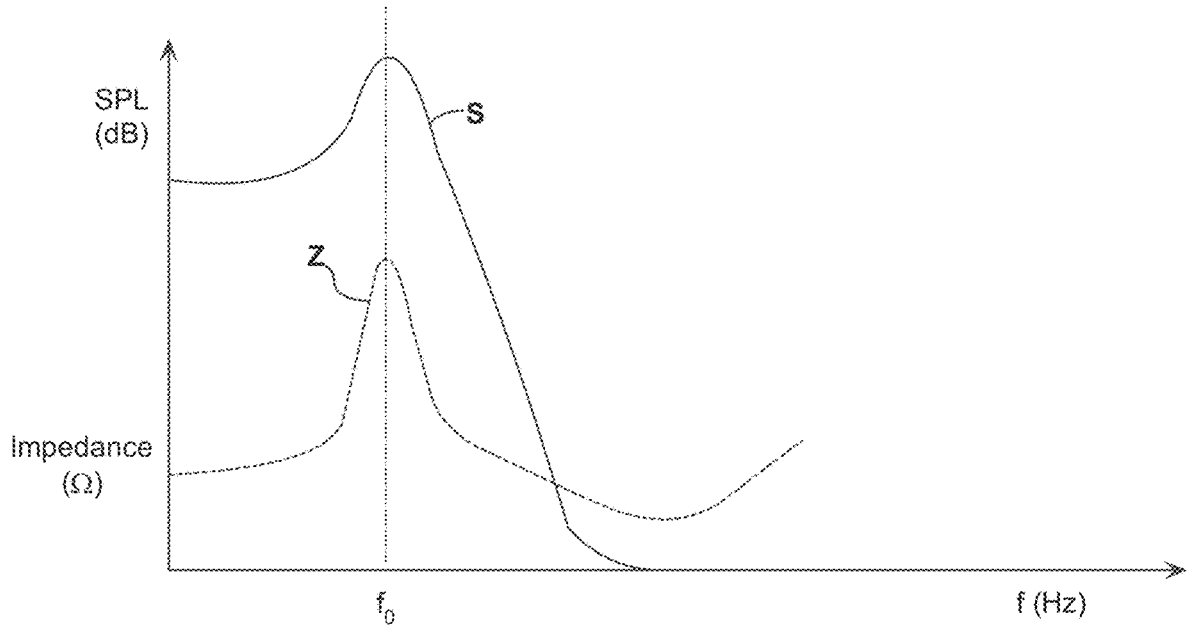
FIG. 1A and FIG. 1B are example graphs showing the electro-acoustic response of two different micro-speakers as may be driven by circuits and systems in accordance with embodiments of the disclosure.
Figure 1B:
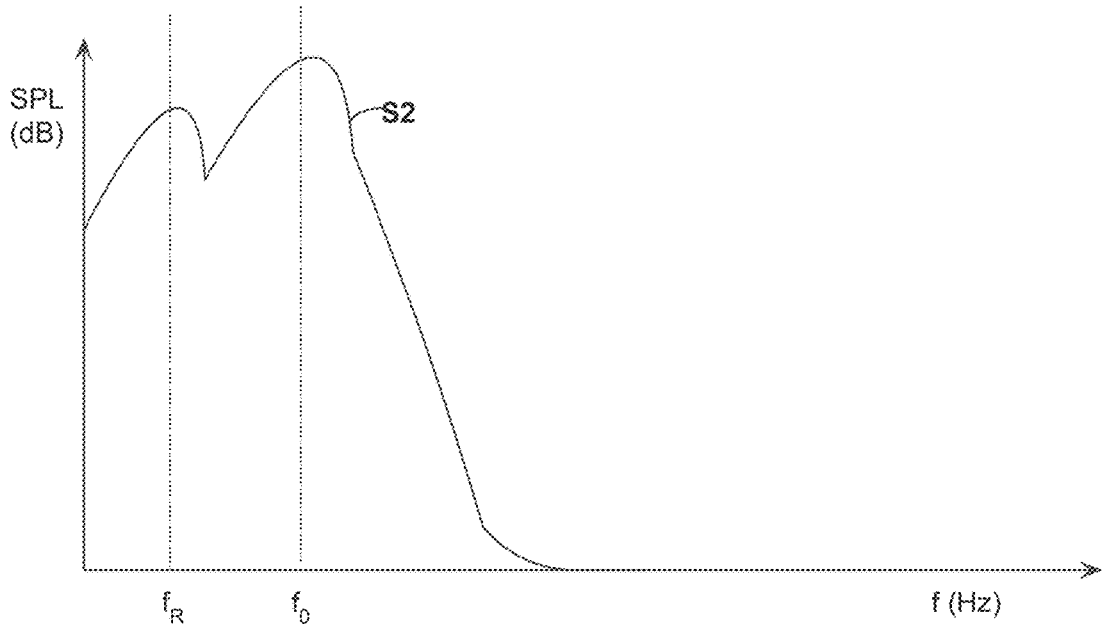

Referring now to FIG. 1A, an example graph of electroacoustic response of a micro-speaker is shown, as an amplitude response S (sound pressure level) and input (terminal) impedance Z. A peak in the amplitude response S is seen at a resonant frequency $f_0$ of the speaker, as well as an increase in input impedance Z. Ordinarily, when operating a micro-speaker, frequencies near and below resonance are avoided, e.g., attenuated by the circuits that drive the micro-speaker, since large voice coil excursions will otherwise result, which may damage the micro-speaker. Due to recent improvements in voice coil excursion handling ability in micro-speakers, the instant disclosure discloses circuits and systems that selectively provide a "cooling component" at or near the resonant frequency of the micro-speaker, as the large excursions that result provide cooling of the voice coil. The cooling component is selectively introduced when a temperature threshold of the voice coil has been reached, or alternatively the magnitude of a cooling component may be increased as an increased voice coil temperature is detected, so that the temperature of the micro-speaker can be maintained within an acceptable operating range. FIG. 1B shows another amplitude response S2 of the same micro-speaker is shown with an additional resonance introduced at a second resonant frequency $f_R$. Second resonant frequency $f_R$ may be provided by mechanical loading, such as a closed or ported volume of air behind the micro-speaker (e.g., the internal empty volume of a device in which the micro-speaker is mounted and/or another micro-speaker, passive radiator or port(s) provided in the housing of the device. In the illustrated amplitude response S2 second resonant frequency $f_R$ might be, for example, a sub-audible frequency such as at or below 20 Hz, while resonant frequency $f_0$ is within the audible frequency range, e.g. 500 Hz and therefore a cooling component at resonant frequency $f_0$ of 500 Hz would be audible, but a cooling component at or below 20 Hz would not be. Therefore, in some embodiments of the disclosure, the cooling component will be at a frequency with low audibility. In other embodiments of the disclosure the cooling component is masked by other audio information or is otherwise provided in a manner that acoustically cancels the cooling component while still providing cooling.

Figure 2A:
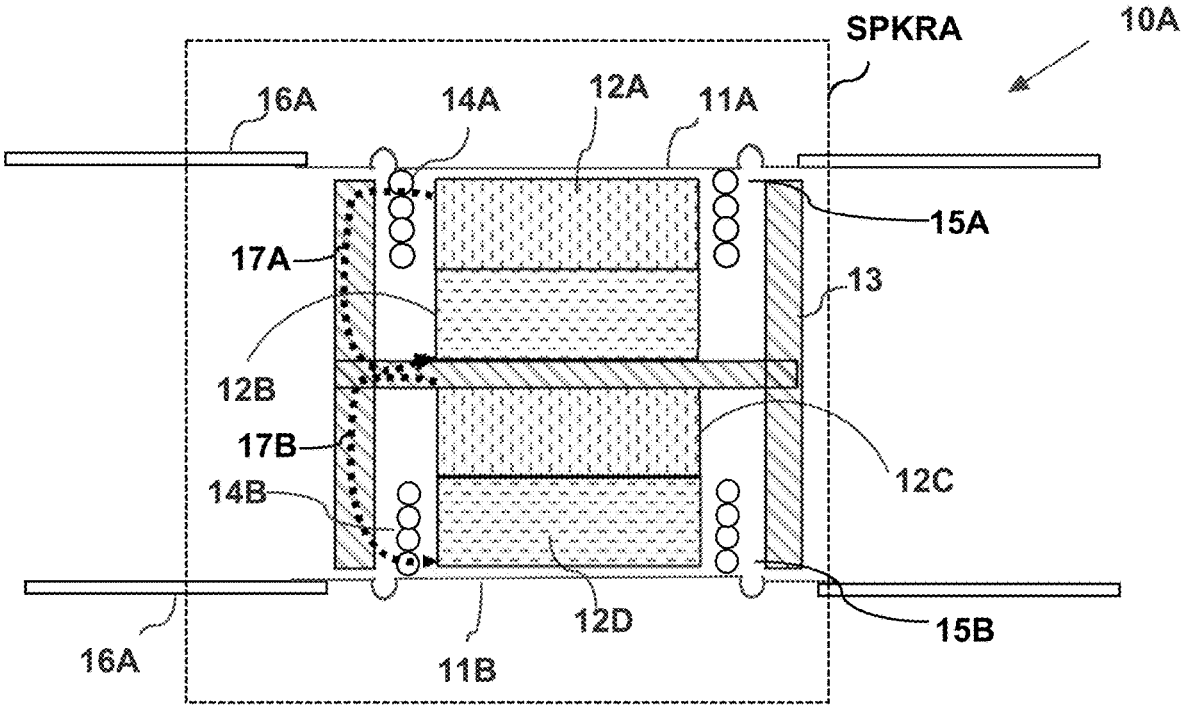
FIG. 2A is an example cross-section view of a device 10A including an electroacoustic transducer that may be driven by circuits and systems accordance with an embodiment of the disclosure.

Referring now to FIG. 2A, an example device 10A is shown in accordance with an embodiment of the disclosure. A micro-speaker SPKRA is included within a housing 16A of device 10A by the attachment of diaphragms 11A and 11B on opposite sides of housing 16A. Diaphragm 11A is moved by a voice coil 14A and diaphragm 11B is moved by a voice coil 14B and the mechanical structure of diaphragm 11A and voice coil 14A is similar to that of diaphragm 11B and voice coil 14B, so that their resonant frequencies coincide. A frame 13 supports a set of permanent magnets that have opposite polarity, and which are illustrated as North pole 12A with South pole 12B and South pole 12D with North pole 12C. Frame 13 is formed from a magnetically-conductive material such as nickel, iron, steel or an alloy such as μ-metal, so that flux loops 17A, 17B are closed for each side of the micro-speaker at the outer-edges of gaps 15A, 15B formed between frame 13 and the outer poles 12A, 12D of the magnets, and have opposite polarities with respect to voice coils 14A and 14B due to the reversal of the poles between the two sides of frame 13. When voice coils 14A and 14B are driven with in-phase signals, diaphragms 11A and 11B move in the same absolute direction, so that as one of diaphragms 11A, 11B is extended from housing 16A, the other one of diaphragms 11A, 11B is drawn into housing 16A. The result is a net addition of acoustic output, assuming that the dimensions are relatively small with respect to a wavelength of the sounds being reproduced. For cooling, the cooling component of the drive signal is introduced in an out-of-phase relationship between voice coils 14A and 14B, so that the acoustic output due to the cooling component from diaphragms 11A, 11B substantially cancels.

Figure 2B:
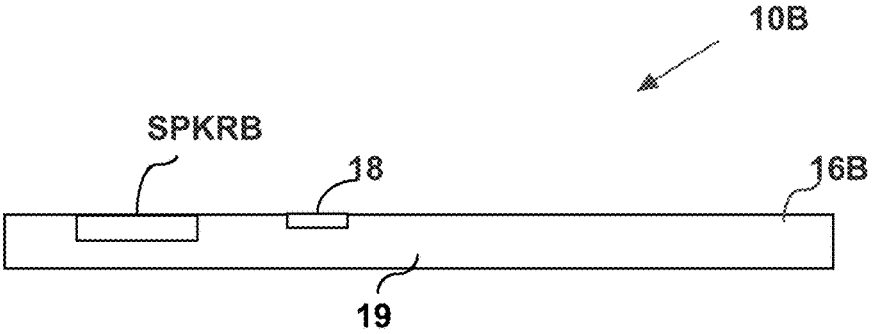
FIG. 2B is an example cross-section side view of a device 10B in which one or more electroacoustic transducers may be driven by circuits and systems accordance with an embodiment of the disclosure.

Referring now to FIG. 2B, an example device 10B is shown in accordance with another embodiment of the disclosure. A micro-speaker SPKRB is included within a housing 16B of device 10B, and another acoustic element 18 is provided to change or provide another resonant frequency in the acoustic response of micro-speaker SPKRB. Acoustic element 18 may be another micro-speaker driven by the same output signal as SPKRB, or a passive acoustic element that interacts with the diaphragm of micro-speaker SPKRB due to coupling via an internal airspace 19 of housing 16B. Examples of such a passive acoustic element are: a passive radiator, e.g., a film over a hole in housing 16B, or a port such as a hole through housing 16B. Such techniques may be used to introduce the second resonant frequency $f_R$ illustrated in FIG. 1B.

Figure 3:
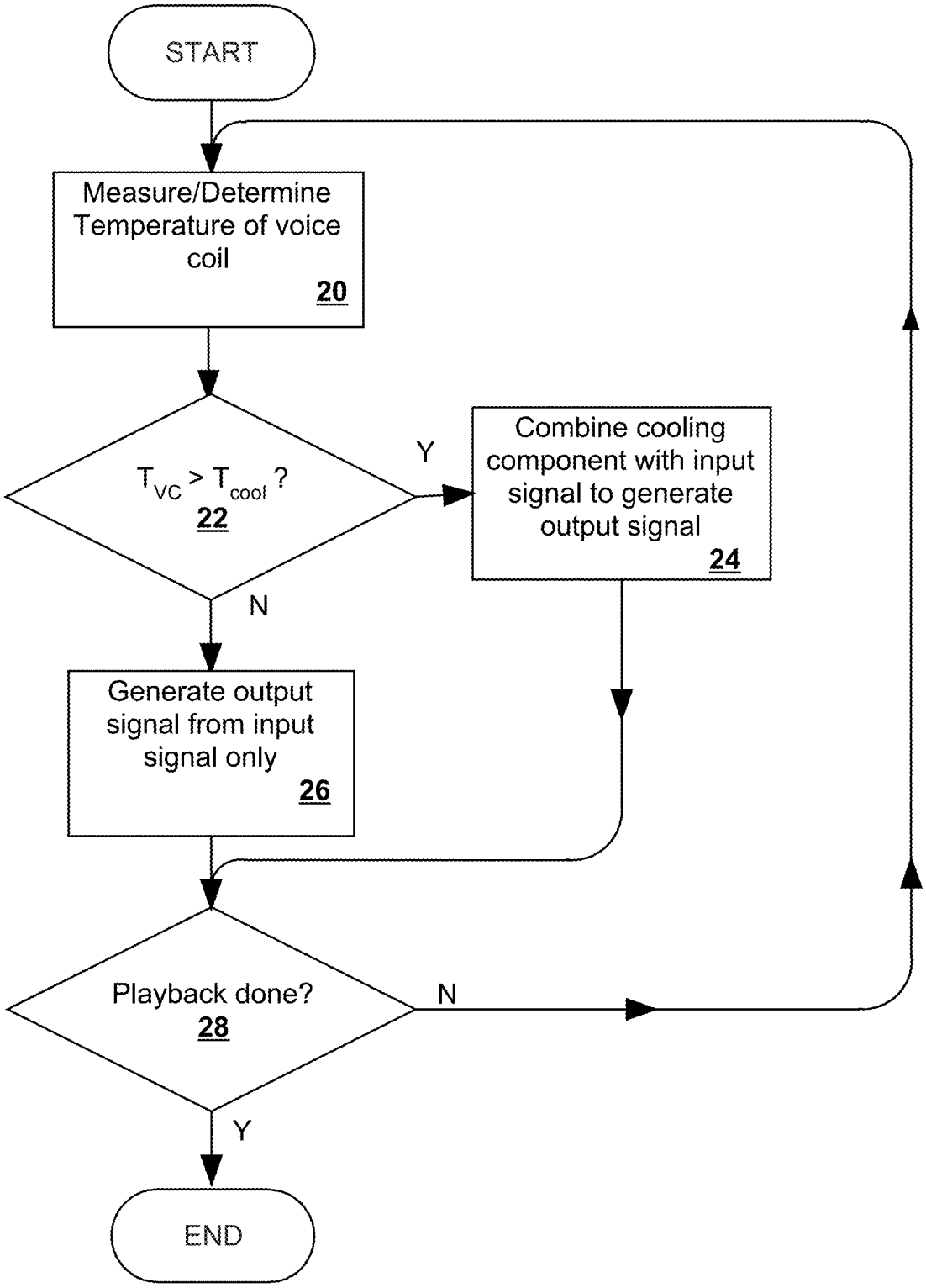
FIG. 3 is an example flowchart showing a method in accordance with an embodiment of the disclosure.

Referring to FIG. 3, a flowchart of an example method is shown, in accordance with an embodiment of the disclosure. The temperature of the voice coil of the micro-speaker is determined, e.g., by measuring resistance of the voice coil or is measured directly (step 20). The voice coil temperature $T_{VC}$ is compared to an allowable threshold temperature $T_{cool}$ (decision 22) and if the allowable threshold temperature $T_{cool}$ is exceeded, then a cooling component is combined with the input signal to generate the output signal (step 24). Otherwise the output signal is generated only from the input signal (step 26). Until playback is done (decision 28), the process of steps 20-28 is repeated to continuously track voice coil temperature $T_{VC}$ and protect against overheating.

Figure 4A:
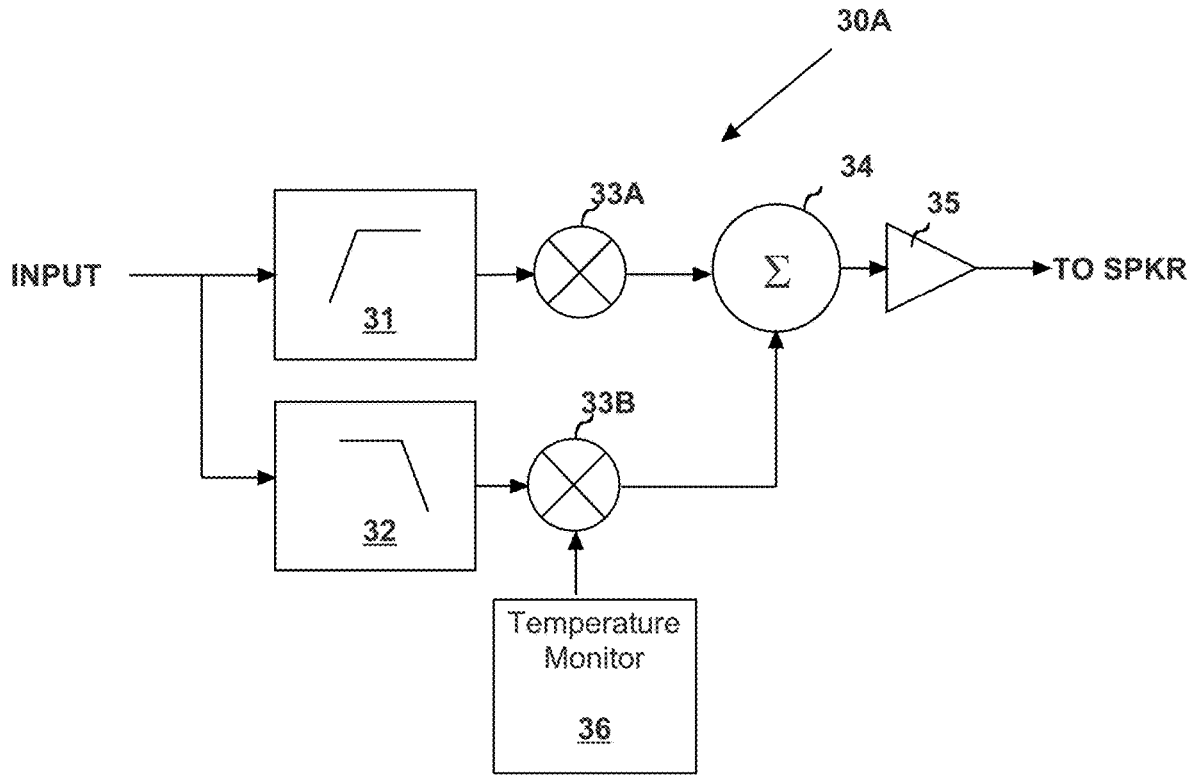
FIG. 4A and FIG. 4B are simplified example block diagrams of processing systems in accordance with different embodiments of the disclosure.

Referring to FIG. 4A, a block diagram of an example system 30A in accordance with an embodiment of the disclosure is shown. In system 30A, an input signal INPUT is split into two bands by a high-pass filter 31 and a low-pass filter 32. The output of high-pass filter 31 contains the program information that is only altered by a gain value applied by a multiplier 33A. The output of low-pass filter, which contains any content of input signal INPUT at or near the resonant frequency of the transducer to be driven, has a gain selectively applied by a multiplier 33B that is controlled by a temperature monitor 36. Temperature monitor 36 determines or measures the temperature of a voice coil of the transducer being driven by example system 30A and either selectively applies a gain of zero when voice coil temperature $T_{VC}$ is at or below allowable threshold temperature $T_{cool}$, or applies a variable gain that is determined in accordance with voice coil temperature $T_{VC}$. A combiner 34 combines the outputs of multipliers 33A and 33B and provides an output signal to an amplifier 35 that provides output signal TO SPKR, which is provided to the transducer. Example system 30A provides an example of a system in which the input signal being reproduced provides the content of the cooling component used for cooling the transducer voice coil.

Figure 4B:
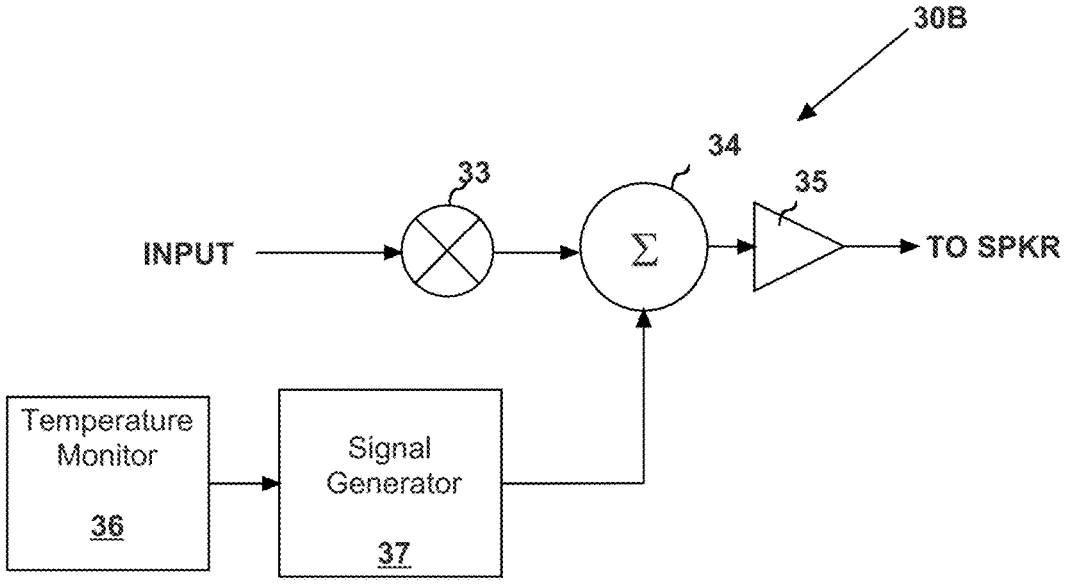

Referring to FIG. 4B, a block diagram of another example system 30B in accordance with another embodiment of the disclosure is shown. Example system 30B has some common elements with example system 30A, and therefore only differences between example system 30B and example system 30A of FIG. 4A will be described in detail below. Example system 30B is an example of a system in which an additional signal providing the cooling component is generated by a signal generator 37 that is controlled by temperature monitor 36. In a manner similar to that of example system 30A, temperature monitor 36 may enable signal generator 37 when voice coil temperature $T_{VC}$ is above allowable threshold temperature $T_{cool}$ and disable signal generator 37 when voice coil temperature $T_{VC}$ is at or below allowable threshold temperature $T_{cool}$. Alternatively, temperature monitor 36 may provide a control signal that controls the amplitude of the cooling component generated by signal generator 37 according to voice coil temperature $T_{VC}$.

Figure 5:
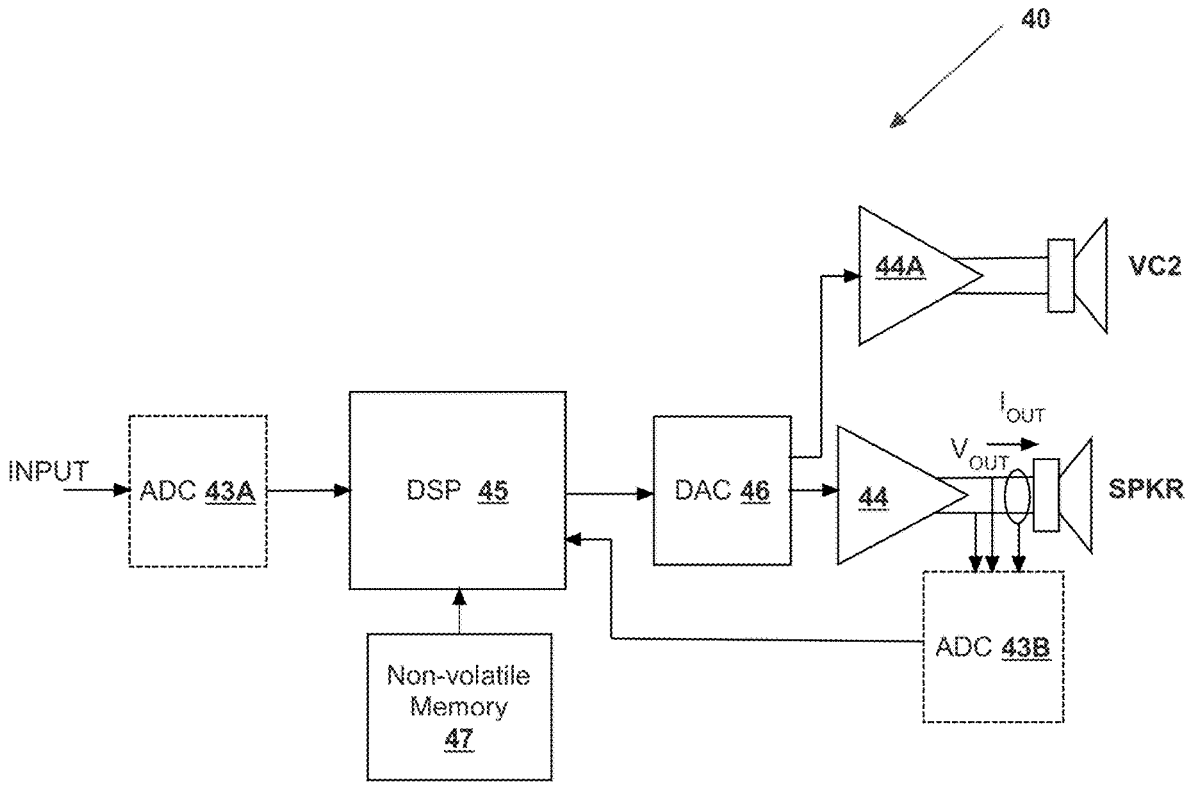
FIG. 5 is an example block diagram of a digital signal processing system that may be used to implement systems and circuits in accordance with embodiments of the disclosure.

Referring now to FIG. 5, an example digital signal processing system 40 is shown, which may be used to implement the techniques of the present disclosure. A digital signal processor (DSP) 45 (or a suitable general-purpose processor) executes program instructions stored in a non-volatile memory 47 and that form a computer-program product in accordance with the present disclosure. DSP 45 receives samples of the audio input signal, which may be from a digital program source, such as a CODEC, or from an analog-to-digital converter (ADC) 43A that receives an analog signal from a program source at an input INPUT. DSP 45 also receives samples of the output voltage $V_{out}$ and output current $I_{out}$ at the input terminals of a transducer SPKR provided from another ADC 43B. An output current $I_{out}$ analog may be provided by a voltage drop across a series resistance included in the output circuit between amplifier 44 and transducer SPKR or may be provided directly from amplifier 44 via a current mirror or other internal arrangement. The DC (average) values of output voltage $V_{out}$ and output current $I_{out}$ may then be used to determine the voice coil resistance $R_{vc}=Avg(V_{out}/I_{out})$, which is proportional to the temperature of the voice coil $R_{vc}=kT_{VC}+R_0$, where $R_0$ is the value of $R_{vc}$ at voice coil temperature $T_{VC}=0$ and k is a temperature coefficient of resistance of the metal forming the conductor of the voice coil. Alternatively, ADC 43B may receive an input from a thermistor, thermocouple or other device having an output voltage or current dependent on the temperature of the frame of transducer SPKR, which may be used as an analog of the voice coil temperature. A digital-to-analog converter (DAC) 46 receives output values corresponding to the processed amplifier output signal $V_{out}$, which represent audio input samples that have been processed according to the processes described above with reference to FIG. 3 and FIGS. 4A-4B, to include a cooling component when voice coil temperature $T_{VC}$ exceeds allowable temperature threshold $T_{cool}$. DAC 46 provides an output signal to amplifier 44, which generates the output voltage waveform $V_{out}$ to drive transducer SPKR. Alternatively, DSP 45 may provide samples to a pulse-width modulator (PWM) (class-D) type amplifier or generate PWM signals directly provided to switching circuits. If a dual voice-coil transducer such as that shown in FIG. 2A is being driven, then a first one of the voice coils may be connected to the output of amplifier and a second amplifier 44A provided to drive the separate second voice coil VC2. The signal provided to the input of second amplifier 44A by DAC 46 will have the cooling component provided in reverse phase before summing the cooling component with the other signal components.

Figure 6:
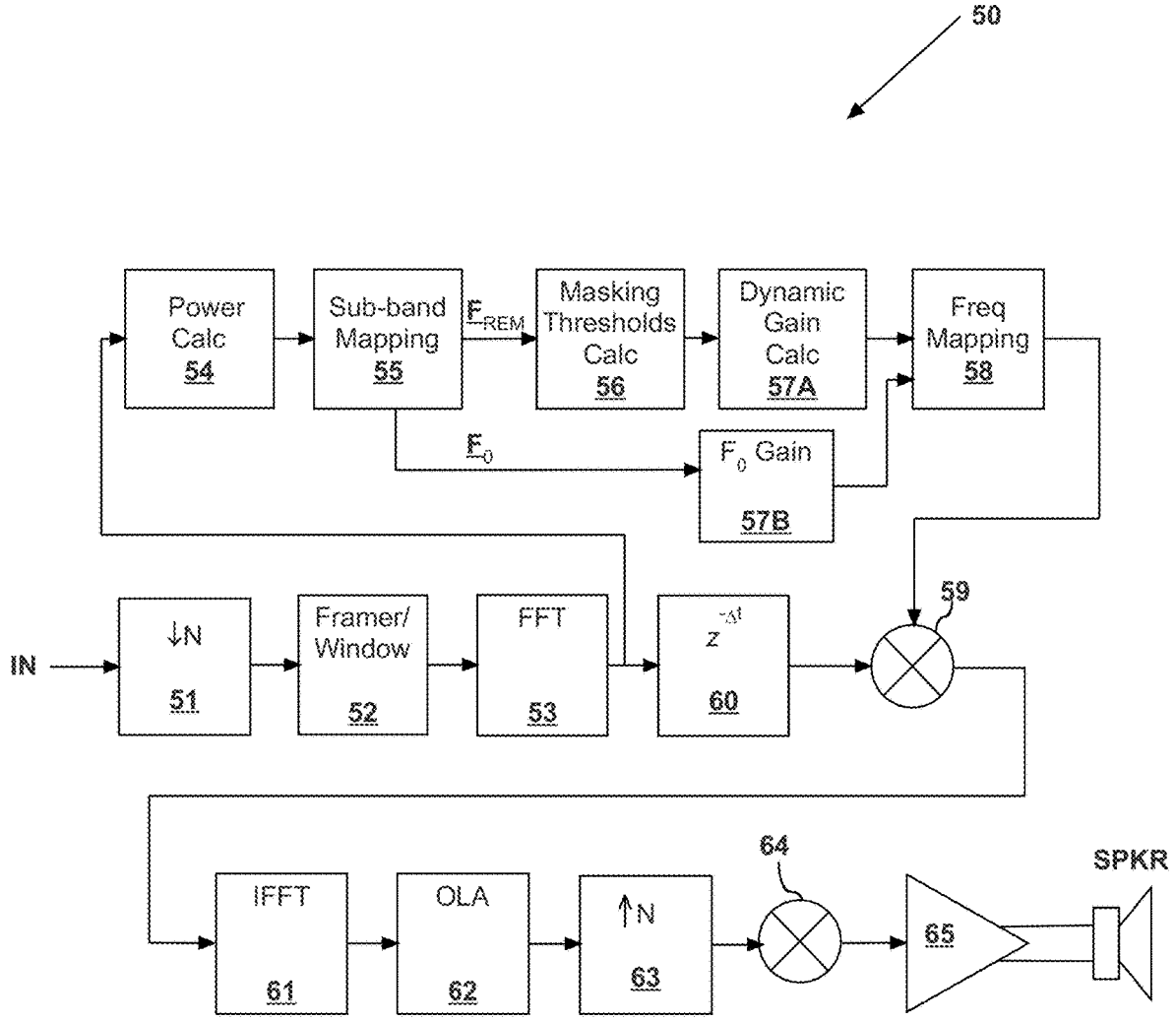
FIG. 6 is an example block diagram illustrating a system in accordance with an embodiment of the disclosure.

Referring now to FIG. 6, an example signal processing system 50 is shown, in accordance with an embodiment of the disclosure. In example system 50, digital input samples provided by input IN are decimated by a factor of N by a decimation block 51 and a framing block 52 groups the samples and applies any windowing function. The input signal is analyzed by a FFT block 53 to provide a set of FFT coefficients representing the signal corresponding to input values IN. A power calculation block 54 computes the power for each FFT component and a sub-band mapping block 55 maps the FFT components to the sub-bands of interest, i.e., the resonance sub-band $F_0$ in which the cooling component is to be introduced and one or more sub-bands $F_{REM}$ representing a remainder of the input signal information. The resonance band $F_0$ is sent to a static gain block, which generally applies unity gain if the temperature of the voice coils exceeds the allowable temperature threshold, and blocks the cooling component, i.e., the resonance band, if the allowable temperature threshold is not exceeded. The remainder of the sub-bands may be sent through a masking thresholds calculation block 56 which determines gains to apply to the sub-bands based on psychoacoustic masking relationships to change the gain values for each group of FFT components corresponding to the sub-bands in the remainder of the sub-bands $F_{REM}$, and a dynamic gain calculation block applies the gains for the remainder of the sub-bands $F_{REM}$. A frequency mapping block 58 determines the gains to apply to each of the FFT components, according to which sub-band the components belong, and a multiplier 59 applies the gain values to the components at the output of FFT block 53 to apply the gains. A compensating delay 60 delays the output of FFT block 53 by an amount of time taken in computation of the output of frequency mapping block 58, i.e., the delay through blocks 54-58, so that the gain value applied by multiplier 59 is synchronized with the audio information at the output of compensation delay 60. The components are then processed by an inverse FFT (IFFT) block 61 and an overlap add (OLA) block 62 to re-synthesize the input signal represented by input values IN as modified by the gains applied to the components according to whether or not cooling is needed. The output of OLA block 62 is interpolated upward by a factor of N by an interpolator 63 and provided to output gain control 64, which provides the input to power output stage 65, which then delivers the power output signal to micro-speaker SPKR.

While the description above with reference to the Figures has been generally directed toward circuits and systems that drive micro-speakers, other electroacoustic transducers such as haptic feedback devices that include voice coils or motor windings may be driven by circuits and systems according to the embodiments of the disclosure described above. However, some modifications may be required for haptic devices to provide cooling when driven by signals having a cooling component, i.e., a signal at or near a resonant frequency of the transducer. FIG. 6A shows an example of an eccentric rotating mass (ERM)-type haptic feedback device 70A that in addition to rotating an eccentric mass 71 by an axle 74 of a motor 72, motor 72 also rotates a set of fan blades 73 which provide cooling of motor 72 when haptic feedback device 70A is vibrated at low frequencies.

Figure 7A:
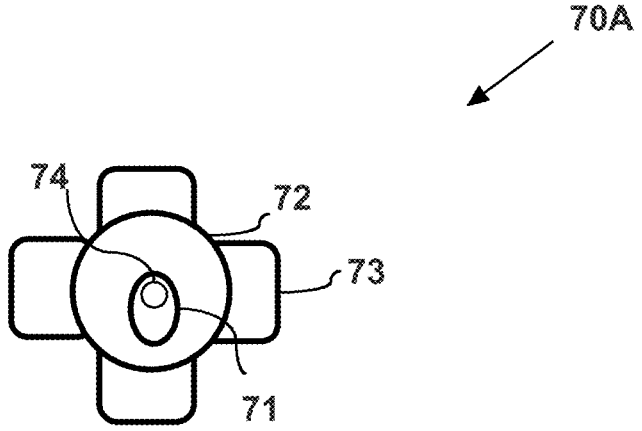
FIG. 7A and FIG. 7B are example pictorial diagrams illustrating haptic devices that may be driven by systems and circuits in accordance with embodiments of the disclosure.
Figure 7B:
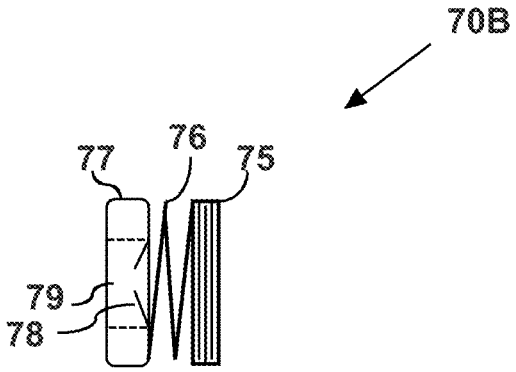

FIG. 7B shows another example of a linear resonant actuator (LRA)-type haptic feedback device 70B, that, in addition to a mass 77, a spring 76 and a voice coil 75, as generally provided in the construction of LRA-type haptic devices, includes an aperture 79 extending through mass 77 and an annular or segmented pair of vanes 78 that will move air in and out of aperture 79 to cool voice coil 75 when haptic feedback device 70B is vibrated at low frequencies.

As mentioned above portions or all of the disclosed process may be carried out by the execution of a collection of program instructions forming a computer program product stored on a non-volatile memory, but that also exist outside of the non-volatile memory in tangible forms of storage forming a computer-readable storage medium. The computer-readable storage medium may be, for example, but is not limited to, an electronic storage device, a magnetic storage device, an optical storage device, an electromagnetic storage device, a semiconductor storage device, or any suitable combination of the foregoing. Specific examples of the computer-readable storage medium include the following: a hard disk, semiconductor volatile and non-volatile memory devices, a portable compact disc read-only memory (CD-ROM) or a digital versatile disk (DVD), a memory stick, a floppy disk or other suitable storage device not specifically enumerated. A computer-readable storage medium, as used herein, is not to be construed as being transitory signals, such as transmission line or radio waves or electrical signals transmitted through a wire. It is understood that blocks of the block diagrams described above may be implemented by computer-readable program instructions. These computer readable program instructions may also be stored in other storage forms as mentioned above and may be downloaded into a non-volatile memory for execution therefrom. However, the collection of instructions stored on media other than the non-volatile memory described above also form a computer program product that is an article of manufacture including instructions which implement aspects of the functions/actions specified in the block diagram block or blocks, as well as method steps described above.

In summary, this disclosure shows and describes circuits, systems, methods and computer program products that provide a power output signal to an electromechanical transducer. The method is a method of operation of the systems, circuits and computer program product. The system and circuit include a sensing circuit for determining an indication of a temperature of a voice coil of the electromechanical transducer, an amplifier for generating the output signal from the input signal, and a signal processing circuit that compares the indication of the temperature of the voice coil to a thermal limit of the transducer and responsive to the thermal limit of the transducer being exceeded by the indication of the temperature of the voice coil, introduces a cooling component to the input signal. The cooling component is a signal having a frequency within a low-frequency resonance portion of the response of the electromechanical transducer, such that additional air convection is caused at the transducer to remove heat from the voice coil due to the cooling component of the input signal.

The electromechanical transducer may be a micro-speaker, and the low-frequency resonance portion of the response of the electromechanical transducer may be within an audible frequency range. The electromechanical transducer may alternatively be a haptic feedback device. The signal processing circuit may further determine whether the input signal contains energy at frequencies that are masked or at which the transducer has a reduced response such that energy would be expended reproducing portions of the input signal that would not be perceived by a listener, remove portions of the output signal that correspond to the energy that would be expended reproducing the portions of the input signal that would not be perceived by a listener, and selectively, in response to the thermal limit of the transducer being exceeded by the indication of the temperature of the voice coil, not removing the portions of the output signal having a frequency within a low-frequency resonance portion of the response of the micro-speaker. The signal processing circuit may further filter the input signal with a response simulating a frequency response of the transducer, compare the filtered input signal with a frequency-dependent threshold of hearing, and remove portions of the output signal that have an amplitude below the frequency-dependent threshold of hearing. The signal processing circuit may further split the input signal into first input signal components in a first frequency band including the resonance portion of the response of the electromechanical transducer and second input signal components in a second frequency band including frequencies above the first frequency band, and selectively remove the portions of the output signal having a frequency within the low-frequency resonance portion of the response of the micro-speaker so that the first input signal components as represented in the output signal are not removed. The signal processing circuit may further split the input signal into first input signal components in a first frequency band including the resonance portion of the response of the micro-speaker and second input signal components in a second frequency band including frequencies above the first frequency band, and may introduce the cooling component by increasing a gain applied to the first input signal components as represented in the output signal. The signal processing circuit may include a processor core and a memory coupled to the processor core storing program instructions for comparing the indication of the temperature of the voice coil to the thermal limit of the transducer and responsive to the thermal limit of the transducer being exceeded by the indication of the temperature of the voice coil, introducing the cooling component to the input signal.

The transducer may be mounted in a housing, and the resonant frequency of the transducer may be shifted by introducing a mechanical loading to the transducer. The electromechanical transducer may be a micro-speaker, the low-frequency resonance portion of the response of the electromechanical transducer may be within an audible frequency range, and the mechanical loading may be provided by another passive or active speaker mounted in the housing. The signal processing circuit may split the input signal into first input signal components in a first frequency band including the resonance portion of the response of the electromechanical transducer and second input signal components in a second frequency band including frequencies above the first frequency band, and the cooling component may be introduced by increasing a gain applied to the first input signal components as represented in the output signal. The micro-speaker may have multiple voice coils, including the voice coil and multiple corresponding diaphragms mechanically coupled to one of the multiple voice coils, and the cooling component may be imposed differentially across the multiple voice coils so that the diaphragms move in opposite directions causing acoustic cancelation of the cooling component. The output signal may be imposed across the multiple voice coils so that the diaphragms move in the same direction in response to the input signal. The micro-speaker may be a first micro-speaker having a first voice coil and a second micro-speaker may be provided having a second voice coil. The first micro-speaker and the second micro-speaker may be acoustically coupled via one or more air passages of a housing in which the first and second micro-speakers are mounted, and the cooling component may be imposed in opposing phases across the first and second voice coils so that the diaphragms move in opposite directions causing acoustic cancelation of the cooling component, while the output signal may be imposed across the first and second voice coils in an in-phase relationship so that the diaphragms move in the same direction in response to the input signal. The first micro-speaker and the second micro-speaker may be mounted on opposite sides of the housing, and the in-phase relationship may be provided by a first signal provided to the first voice coil representing the input signal and a second signal provided to the second voice coil representing an inversion of the input signal.

While the disclosure has shown and described particular embodiments of the techniques disclosed herein, it will be understood by those skilled in the art that the foregoing and other changes in form, and details may be made therein without departing from the spirit and scope of the disclosure. For example, the techniques shown above may be applied in systems with other types of transducers, such as linear motors.

What is claimed is:

1. A method of thermally protecting a micro-speaker that reproduces an input signal, the method comprising:

generating an output signal provided to the micro-speaker from the input signal;

determining an indication of a temperature of a voice coil of the micro-speaker;

comparing the indication of the temperature of the voice coil to a thermal limit of the micro-speaker;

responsive to the thermal limit of the micro-speaker being exceeded by the indication of the temperature of the voice coil, introducing a cooling component to the output signal, wherein the cooling component is a signal having a frequency within a low-frequency resonance portion of the response of the micro-speaker that is within an audible frequency range, such that additional air convection is caused at the micro-speaker to remove heat from the voice coil due to the cooling component of the output signal determining whether the input signal contains energy at frequencies that are masked or at which the micro-speaker has a reduced response such that energy would be expended reproducing portions of the input signal that would not be perceived by a listener; and selectively, in response to the thermal limit of the micro-speaker not being exceeded by the indication of the temperature of the voice coil, removing portions of the output signal that correspond to the energy that would be expended reproducing the portions of the input signal that would not be perceived by a listener, so that the removing of portions of the output signal does not remove the portions of the output signal having a frequency within a low-frequency resonance portion of the response of the micro-speaker if the thermal limit of the micro-speaker is exceeded by the indication of the temperature of the voice coil.

2. The method of claim 1, wherein the determining whether the input signal contains energy at frequencies that are masked or at which the micro-speaker has a reduced response such that energy would be expended reproducing portions of the input signal that would not be perceived by a listener comprises:

filtering the input signal with a response simulating a frequency response of the micro-speaker; and comparing the filtered input signal with a frequency-dependent threshold of hearing, and wherein the removing comprises removing portions of the output signal that have an amplitude below the frequency-dependent threshold of hearing.

3. The method of claim 1, further comprising splitting the input signal into first input signal components in a first frequency band including the resonance portion of the response of the micro-speaker and second input signal components in a second frequency band including frequencies above the first frequency band, and wherein the selectively removing the portions of the output signal having a frequency within the low-frequency resonance portion of the response of the micro-speaker is performed by removing the first input signal components as represented in the output signal, whereby the first input signal components are represented in the output signal if the thermal limit of the micro-speaker is exceeded by the indication of the temperature of the voice coil.

4. The method of claim 1, wherein the micro-speaker has multiple voice coils including the voice coil and multiple corresponding diaphragms mechanically coupled to a corresponding one of the multiple voice coils, wherein the cooling component is imposed differentially across the multiple voice coils so that the diaphragms move in opposite directions causing acoustic cancelation of the cooling component, while the output signal is imposed across the multiple voice coils so that the diaphragms move in the same direction in response to the input signal.

5. The method of claim 1, further comprising providing a second micro-speaker having a second voice coil, wherein the first micro-speaker and the second micro-speaker are acoustically coupled via one or more air passages of a housing in which the first and second micro-speakers are mounted, and wherein the cooling component is imposed in opposing phases across the first and second voice coils so that the diaphragms move in opposite directions causing acoustic cancelation of the cooling component, while the output signal is imposed across the first and second voice coils in an in-phase relationship so that the diaphragms move in the same direction in response to the input signal.

6. The method of claim 5, wherein the first micro-speaker and the second micro-speaker are mounted on opposite sides of the housing, wherein the in-phase relationship is provided by a first signal provided to the first voice coil representing the input signal and a second signal provided to the second voice coil representing an inversion of the input signal.

7. The method of claim 1, wherein the micro-speaker is mounted in a housing, and further comprising shifting the resonant frequency of the micro-speaker by introducing a mechanical loading to the micro-speaker.

8. The method of claim 7, wherein the mechanical loading is provided by another passive or active speaker mounted in the housing.

9. The method of claim 1, further comprising splitting the input signal into first input signal components in a first frequency band including the resonance portion of the response of the micro-speaker and second input signal components in a second frequency band including frequencies above the first frequency band, and wherein the introducing a cooling component comprises increasing a gain applied to the first input signal components as represented in the output signal.

10. A circuit for providing an output signal to a micro-speaker that reproduces an input signal, comprising:

a sensing circuit for determining an indication of a temperature of a voice coil of the micro-speaker;

an amplifier for generating the output signal from the input signal; and a signal processing circuit that compares the indication of the temperature of the voice coil to a thermal limit of the micro-speaker and responsive to the thermal limit of the micro-speaker being exceeded by the indication of the temperature of the voice coil, introduces a cooling component to the input signal, wherein the cooling component is a signal having a frequency within a low-frequency resonance portion of the response of the micro-speaker that is within an audible frequency range, such that additional air convection is caused at the micro-speaker to remove heat from the voice coil due to the cooling component of the input signal, wherein the signal processing circuit further determines whether the input signal contains energy at frequencies that are masked or at which the micro-speaker has a reduced response such that energy would be expended reproducing portions of the input signal that would not be perceived by a listener, and selectively, in response to the thermal limit of the micro-speaker not being exceeded by the indication of the temperature of the voice coil, removes portions of the output signal that correspond to the energy that would be expended reproducing the portions of the input signal that would not be perceived by a listener, so that the removal of portions of the output signal does not remove the portions of the output signal having a frequency within a low-frequency resonance portion of the response of the micro-speaker if the thermal limit of the micro-speaker is exceeded.

11. The circuit of claim 10, wherein the signal processing circuit further filters the input signal with a response simulating a frequency response of the micro-speaker, compares the filtered input signal with a frequency-dependent threshold of hearing, and removes portions of the output signal that have an amplitude below the frequency-dependent threshold of hearing.

12. The circuit of claim 10, wherein the signal processing circuit splits the input signal into first input signal components in a first frequency band including the low frequency resonance portion of the response of the micro-speaker and second input signal components in a second frequency band including frequencies above the first frequency band, and wherein the selective removal of the portions of the output signal having a frequency within the low-frequency resonance portion of the response of the micro-speaker is performed by removing the first input signal components as represented in the output signal, whereby the first input signal components are represented in the output signal if the thermal limit of the micro-speaker is exceeded by the indication of the temperature of the voice coil.

13. The circuit of claim 10, wherein the signal processing circuit further splits the input signal into first input signal components in a first frequency band including the low frequency resonance portion of the response of the micro-speaker and second input signal components in a second frequency band including frequencies above the first frequency band, and introduces the cooling component by increasing a gain applied to the first input signal components as represented in the output signal.

14. A circuit for providing an output signal to a micro-speaker that reproduces an input signal, comprising:

a sensing circuit for determining an indication of a temperature of a voice coil of the micro-speaker;

an amplifier for generating the output signal from the input signal;

a signal processing circuit that compares the indication of the temperature of the voice coil to a thermal limit of the micro-speaker and responsive to the thermal limit of the micro-speaker being exceeded by the indication of the temperature of the voice coil, introduces a cooling component to the input signal, wherein the cooling component is a signal having a frequency within a low-frequency resonance portion of the response of the micro-speaker that is within an audible frequency range, such that additional air convection is caused at the micro-speaker to remove heat from the voice coil due to the cooling component of the input signal;

a processor core; and a memory coupled to the processor core storing program instructions for comparing the indication of the temperature of the voice coil to the thermal limit of the transducer and responsive to the thermal limit of the micro-speaker being exceeded by the indication of the temperature of the voice coil, introducing the cooling component to the input signal.

15. An audio device, comprising:

a housing;

an audio input source providing an input signal;

at least one micro-speaker mounted on the housing and coupled to an output signal; and a circuit for providing an output signal to the at least one micro-speaker, wherein the circuit includes a sensing circuit for determining an indication of a temperature of a voice coil of the at least one micro-speaker, an amplifier for generating the output signal from the input signal, and a signal processing circuit that compares the indication of the temperature of the voice coil to a thermal limit of the micro-speaker and responsive to the thermal limit of the at least one micro-speaker being exceeded by the indication of the temperature of the voice coil, introduces a cooling component to the input signal, wherein the cooling component is a signal having a frequency within a low-frequency resonance portion of the response of the micro-speaker, such that additional air convection is caused at the at least one micro-speaker to remove heat from the voice coil due to the cooling component of the input signal, wherein the at least one micro-speaker has multiple voice coils including the voice coil and multiple corresponding diaphragms mechanically coupled to a corresponding one of the multiple voice coils, wherein the cooling component is imposed differentially across the multiple voice coils so that the diaphragms move in opposite directions causing acoustic cancelation of the cooling component, while the output signal is imposed across the multiple voice coils so that the diaphragms move in the same direction in response to the input signal.

16. A computer-program product comprising a computer-readable storage that is not a signal or propagating wave, the computer-readable storage storing program instructions for:

receiving values representing an input signal;

generating output signal values provided to an electromechanical transducer from the input signal;

determining an indication of a temperature of a voice coil of the electromechanical transducer;

comparing the indication of the temperature of the voice coil to a thermal limit of the electromechanical transducer; and responsive to the thermal limit of the electromechanical transducer being exceeded by the indication of the temperature of the voice coil, introducing a cooling component to the output signal, wherein the cooling component is a signal having a frequency within a low-frequency resonance portion of the response of the electromechanical transducer, such that additional air convection is caused at the electromechanical transducer to remove heat from the voice coil due to the cooling component of the output signal;

determining whether the input signal contains energy at frequencies that are masked or at which the electromechanical transducer has a reduced response such that energy would be expended reproducing portions of the input signal that would not be perceived by a listener; and selectively, in response to the thermal limit of the electromechanical transducer not being exceeded by the indication of the temperature of the voice coil, removing portions of the output signal that correspond to the energy that would be expended reproducing the portions of the input signal that would not be perceived by a listener, so that the removing of portions of the output signal does not remove the portions of the output signal having a frequency within a low-frequency resonance portion of the response of the electromechanical transducer if the thermal limit of the electromechanical transducer is exceeded by the indication of the temperature of the voice coil.

17. The computer-program product of claim 16, wherein the program instructions for determining whether the input signal contains energy at frequencies that are masked or at which the electromechanical transducer has a reduced response such that energy would be expended reproducing portions of the input signal that would not be perceived by a listener comprise program instructions for:

filtering the input signal with a response simulating a frequency response of the electromechanical transducer; and comparing the filtered input signal with a frequency-dependent threshold of hearing, and wherein the removing comprises removing portions of the output signal that have an amplitude below the frequency-dependent threshold of hearing.

18. The computer-program product of claim 17, wherein the program instructions further comprise program instructions for splitting the input signal into first input signal components in a first frequency band including the resonance portion of the response of the electromechanical transducer and second input signal components in a second frequency band including frequencies above the first frequency band, and wherein the selectively removing the portions of the output signal having a frequency within the low-frequency resonance portion of the response of the electromechanical transducer is performed by removing the first input signal components as represented in the output signal, whereby the first input signal components are represented in the output signal if the thermal limit of the electromechanical transducer is exceeded by the indication of the temperature of the voice coil.

19. The computer-program product of claim 16, wherein the program instructions further comprise program instructions for splitting the input signal into first input signal components in a first frequency band including the resonance portion of the response of the electromechanical transducer and second input signal components in a second frequency band including frequencies above the first frequency band, and wherein the introducing a cooling component comprises increasing a gain applied to the first input signal components as represented in the output signal.

20. A method of thermally protecting a micro-speaker that reproduces an input signal, the method comprising:

generating an output signal provided to the micro-speaker from the input signal;

determining an indication of a temperature of a voice coil of the micro-speaker;

comparing the indication of the temperature of the voice coil to a thermal limit of the micro-speaker; and responsive to the thermal limit of the micro-speaker being exceeded by the indication of the temperature of the voice coil, introducing a cooling component to the output signal, wherein the cooling component is a signal having a frequency within a low-frequency resonance portion of the response of the micro-speaker that is within an audible frequency range, such that additional air convection is caused at the micro-speaker to remove heat from the voice coil due to the cooling component of the output signal, wherein the micro-speaker has multiple voice coils including the voice coil and multiple corresponding diaphragms mechanically coupled to a corresponding one of the multiple voice coils, wherein the cooling component is imposed differentially across the multiple voice coils so that the diaphragms move in opposite directions causing acoustic cancelation of the cooling component, while the output signal is imposed across the multiple voice coils so that the diaphragms move in the same direction in response to the input signal.

21. A method of thermally protecting a first micro-speaker and a second micro-speaker that reproduce an input signal, the method comprising:

generating one or more output signals provided to the first micro-speaker and the second micro-speaker from the input signal;

determining an indication of a temperature of a first voice coil of the first micro-speaker;

comparing the indication of the temperature of the first voice coil to a thermal limit of the first micro-speaker; and responsive to the thermal limit of the first micro-speaker being exceeded by the indication of the temperature of the first voice coil, introducing a cooling component to the one or more output signals, wherein the cooling component is a signal having a frequency within a low-frequency resonance portion of the response of the first micro-speaker that is within an audible frequency range, such that additional air convection is caused at the first micro-speaker to remove heat from the voice coil due to the cooling component of the output signal, wherein the first micro-speaker and the second micro-speaker are acoustically coupled via one or more air passages of a housing in which the first and second micro-speakers are mounted, and wherein the cooling component is imposed in opposing phases across the first and second voice coils so that the diaphragms move in opposite directions causing acoustic cancelation of the cooling component, while the output signal is imposed across the first and second voice coils in an in-phase relationship so that the diaphragms move in the same direction in response to the input signal.

22. An audio device, comprising:

a housing;

an audio input source providing an input signal;

at least one micro-speaker mounted on the housing and coupled to an output signal; and a circuit for providing an output signal to the at least one micro-speaker, wherein the circuit includes a sensing circuit for determining an indication of a temperature of a voice coil of the at least one micro-speaker, an amplifier for generating the output signal from the input signal, and a signal processing circuit that compares the indication of the temperature of the voice coil to a thermal limit of the at least one micro-speaker transducer and responsive to the thermal limit of the at least one micro-speaker being exceeded by the indication of the temperature of the voice coil, introduces a cooling component to the input signal, wherein the cooling component is a signal having a frequency within a low-frequency resonance portion of the response of the at least one micro-speaker, such that additional air convection is caused at the at leat one micro-speaker to remove heat from the voice coil due to the cooling component of the input signal, wherein the at least one micro-speaker includes a first micro-speaker having a first voice coil and a second micro-speaker having a second voice coil, wherein the first micro-speaker and the second micro-speaker are acoustically coupled via one or more air passages of a housing in which the first and second micro-speakers are mounted, and wherein the cooling component is imposed in opposing phases across the first and second voice coils so that the diaphragms move in opposite directions causing acoustic cancelation of the cooling component, while the output signal is imposed across the first and second voice coils in an in-phase relationship so that the diaphragms move in the same direction in response to the input signal.

23. The audio device of claim 22, wherein the first micro-speaker and the second micro-speaker are mounted on opposite sides of the housing, wherein the in-phase relationship is provided by a first signal provided to the first voice coil representing the input signal and a second signal provided to the second voice coil representing an inversion of the input signal.

24. An audio device, comprising:

a housing;

an audio input source providing an input signal;

at least one micro-speaker mounted on the housing and coupled to an output signal;

a circuit for providing an output signal to the at least one micro-speaker, wherein the circuit includes a sensing circuit for determining an indication of a temperature of a voice coil of the at least one micro-speaker, an amplifier for generating the output signal from the input signal, and a signal processing circuit that compares the indication of the temperature of the voice coil to a thermal limit of the transducer and responsive to the thermal limit of the at least one micro-speaker being exceeded by the indication of the temperature of the voice coil, introduces a cooling component to the input signal, wherein the cooling component is a signal having a frequency within a low-frequency resonance portion of the response of the micro-speaker, such that additional air convection is caused at the at least one micro-speaker to remove heat from the voice coil due to the cooling component of the input signal; and a mechanical load coupled to the at least one micro-speaker for shifting the resonant frequency of the at least one micro-speaker.

25. The audio device of claim 24, wherein the low-frequency resonance portion of the response of the at least one micro-speaker is within an audible frequency range, and wherein the mechanical load is provided by another passive or active speaker mounted in the housing.

* * * * *